US008376577B2

(12) United States Patent
Harbers et al.

(10) Patent No.: US 8,376,577 B2
(45) Date of Patent: Feb. 19, 2013

(54) MODULAR SOLID STATE LIGHTING DEVICE

(75) Inventors: Gerard Harbers, Sunnyvale, CA (US); Mark A. Pugh, Los Gatos, CA (US)

(73) Assignee: Xicato, Inc., San Jose, CA (US)

( * ) Notice: Subject to any disclaimer, the term of this patent is extended or adjusted under 35 U.S.C. 154(b) by 473 days.

(21) Appl. No.: 12/258,352

(22) Filed: Oct. 24, 2008

(65) Prior Publication Data

US 2009/0116251 A1 May 7, 2009

Related U.S. Application Data

(60) Provisional application No. 61/002,039, filed on Nov. 5, 2007.

(51) Int. Cl.
*F21S 4/00* (2006.01)
*F21V 21/00* (2006.01)

(52) U.S. Cl. ..... 362/249.02; 362/800

(58) Field of Classification Search ..... 362/249.02, 362/311.02, 545, 555, 800
See application file for complete search history.

(56) References Cited

U.S. PATENT DOCUMENTS

| | | | | |
|---|---|---|---|---|
| 5,959,316 | A | 9/1999 | Lowery | |
| 6,252,254 | B1 * | 6/2001 | Soules et al. | 257/89 |
| 6,351,069 | B1 | 2/2002 | Lowery et al. | |
| 6,504,301 | B1 | 1/2003 | Lowery | |
| 6,586,882 | B1 | 7/2003 | Harbers | |
| 6,600,175 | B1 | 7/2003 | Baretz et al. | |
| 6,612,725 | B2 * | 9/2003 | Camarota et al. | 362/372 |
| 6,680,569 | B2 | 1/2004 | Mueller-Mach et al. | |
| 6,812,500 | B2 | 11/2004 | Reeh et al. | |
| 7,126,162 | B2 | 10/2006 | Reeh et al. | |
| 7,226,189 | B2 * | 6/2007 | Lee et al. | 362/294 |
| 7,250,715 | B2 | 7/2007 | Mueller et al. | |
| 7,282,841 | B2 | 10/2007 | Li | |
| 7,466,499 | B2 * | 12/2008 | Takeuchi et al. | 359/738 |
| 7,479,662 | B2 | 1/2009 | Soules et al. | |

(Continued)

FOREIGN PATENT DOCUMENTS

| | | | |
|---|---|---|---|
| DE | 203 08 837 | U1 | 9/2003 |
| DE | 20 2007 004 480 | U1 | 6/2007 |

(Continued)

OTHER PUBLICATIONS

International Search Report mailed on Jan. 22, 2009, for PCT Application No. PCT/US2008/081638 filed on Oct. 29, 2008, by Xicato, Inc., 14 pages.

(Continued)

*Primary Examiner* — Jason Moon Han
(74) *Attorney, Agent, or Firm* — Silicon Valley Patent Group LLP

(57) ABSTRACT

An LED module includes an upper housing with in internal cavity and a lower housing. At least one light emitting diode is held in the LED module and emits light into the internal cavity, which is emitted through an output port in the upper housing. An optical structure, which may be disk or cylinder shaped may be mounted over the output port and light is emitted through the top surface and/or edge surface of the optical structure. The lower housing has a cylindrical external surface, which may be part of a fastener, such as screw threads, so that the LED module can be coupled to a heat sink, bracket or frame. The light emitting diode is thermally coupled to the lower housing, which may serve as a heat spreader. Additionally, a flange may be disposed between the upper housing and lower housing.

55 Claims, 12 Drawing Sheets

U.S. PATENT DOCUMENTS

| | | | | |
|---|---|---|---|---|
| 7,564,180 | B2 | 7/2009 | Brandes | |
| 7,614,759 | B2 | 11/2009 | Negley | |
| 7,629,621 | B2 | 12/2009 | Reeh et al. | |
| 7,766,512 | B2 * | 8/2010 | Chou et al. | 362/294 |
| 2007/0058357 | A1 | 3/2007 | Yamaguchi et al. | |
| 2007/0081336 | A1 | 4/2007 | Bierhuizen et al. | |
| 2007/0159420 | A1 | 7/2007 | Chen et al. | |
| 2007/0189013 | A1 | 8/2007 | Ford | |

FOREIGN PATENT DOCUMENTS

| | | | |
|---|---|---|---|
| JP | 2003-517705 | A | 5/2003 |
| JP | 2006-324036 | A | 11/2006 |
| JP | 2007-114406 | A | 5/2007 |
| KR | 20-0327640 | | 9/2003 |
| WO | WO 01/36864 | A2 | 5/2001 |
| WO | WO 2004/068909 | | 8/2004 |

OTHER PUBLICATIONS

English Abstract of JP 2006-324036 (A) published on Nov. 30, 2006 by Patent Abstracts of Japan, one page.

English Abstract of KR 20-0327640 published on Sep. 26, 2003, two pages.

International Preliminary Report on Patentability mailed on May 20, 2010, for PCT Application No. PCT/US2008/081638 filed on Oct. 29, 2008, by Xicato, Inc., eight pages.

English Abstract of JP 2007-114406 (A) at <http://worldwide.espacenet.com> visited on Nov. 18, 2011, two pages.

* cited by examiner

MODULAR SOLID STATE LIGHTING DEVICE

CROSS REFERENCE TO RELATED APPLICATIONS

This application claims the benefit of Provisional Application No. 61/002,039 filed Nov. 5, 2007, which is incorporated herein in its entirety.

FIELD OF THE INVENTION

The present invention is related to the field of general illumination, and in particular to an illumination module that uses light emitting diodes (LEDs).

BACKGROUND

Solid state light sources, such as those using LEDs, are not yet frequently used for general illumination. One current difficulty is the production of a form factor that will be easily integrated into the current infrastructure. Moreover, the engineering and manufacturing investments required to overcome challenges associated with the production of solid state light sources renders the costs of solid state illumination installations high compared to that of conventional light sources. As a result, the introduction of an efficient and environmentally safe solid state illumination technology has been delayed. Accordingly, what is desired is an illumination device, which can be inexpensively produced and used with or installed in the existing infrastructure with no or little modification.

SUMMARY

An LED module, in accordance with one embodiment, includes an upper housing with in internal cavity and a lower housing. At least one light emitting diode is held in the LED module and emits light into the internal cavity, which is emitted through an output port in the upper housing. An optical structure, which may be disk or cylinder shaped may be mounted over the output port and light is emitted through the top surface and/or edge surface of the optical structure. The lower housing has a cylindrical external surface, which may be part of a fastener, such as screw threads, so that the LED module can be coupled to a heat sink, bracket or frame. The light emitting diode is thermally coupled to the lower housing, which may serve as a heat spreader. In one embodiment, a flange may be disposed between the upper housing and lower housing. The light emitting diode may be mounted on a board, which is mounted on the top or bottom surface of the flange. A reflective insert may be located within the internal cavity of the upper housing.

DETAILED DESCRIPTION

Figure 1A:
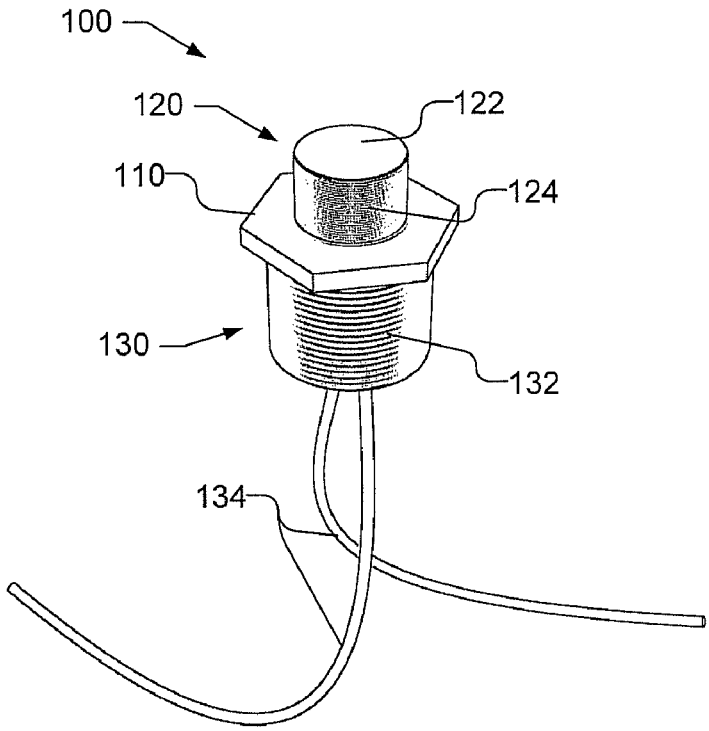
FIGS. 1A and 1B are a perspective view and cross-sectional view, respectively, of one embodiment of an LED module.
Figure 1B:
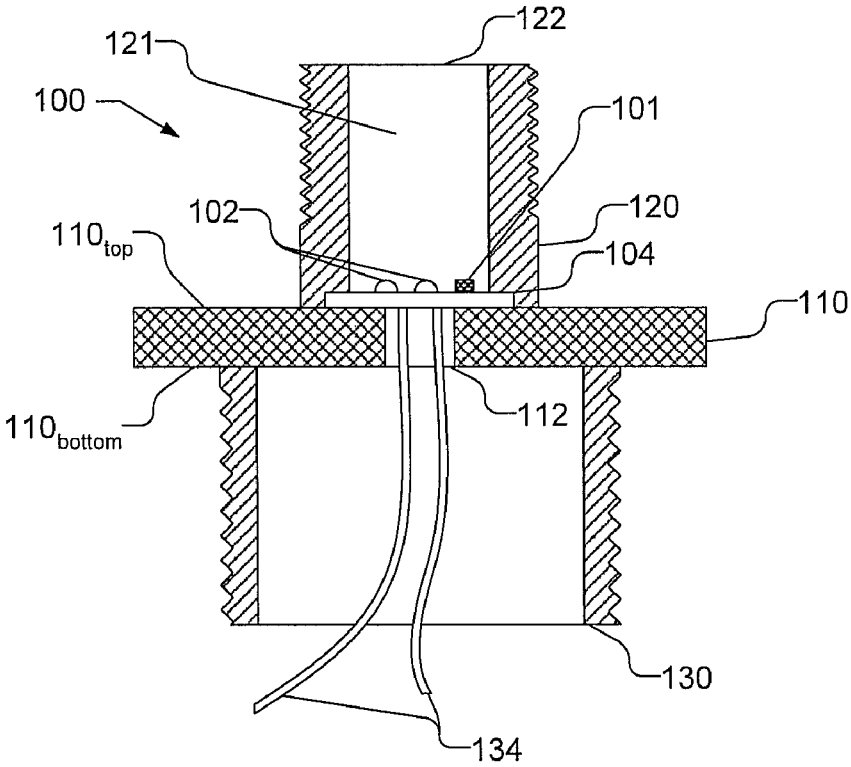

FIGS. 1A and 1B are a perspective view and cross-sectional view, respectively, of one embodiment of an LED module 100. It should be understood that as defined herein an LED module is not an LED, but is a component part of an LED light source or fixture and contains an LED board, which includes one or more LED die or packaged LEDs. LED module 100 is made of a thermally conductive material, for example copper or aluminum or alloys thereof. The LED module 100 may include a flange 110, as well as with a cylindrical top section 120, sometimes referred to as the upper housing, that includes an internal cavity 121 (shown in FIG. 1B) and a light emission output port 122. One or more LEDs 102 are positioned to emit light within the internal cavity 121 of the top section 120 and the light is emitted from the LED module 100 through the output port 122. The output port 122 can be open thereby directly exposing the internal cavity of the top section 120 or it may be covered with an optically transparent or translucent plate.

The LED module 100 further includes a bottom section 130, sometimes referred to as the lower housing, where the flange 110 separates the top section 120 and the bottom section 130. As illustrated, the bottom section 130 includes threads 132 that at least partially covering the exterior surface of the bottom section 130. The threads 132 can be any type but is preferably a standard size, e.g., ½ inch, ¾ inch, or 1 inch, as used in electrical installations in the United States. It may also be any other size as well, depending upon the standard size used in the lighting industry of a particular region.

As illustrated in FIG. 1B, the LEDs 102 may be mounted on an LED board 104 that is mounted on a top surface $\mathbf{110}_{top}$ of the flange 110, e.g., between flange 110 and the internal cavity 121, with wires 134 extending through an aperture 112 in the flange 110. Alternatively, the LED board 104 may be mounted on the bottom surface $\mathbf{110}_{bottom}$ of the flange 110, where the light from the LEDs 102 is emitted into the internal cavity 121 through the aperture 112 of the flange 110. The LED board 104 is a board upon which is mounted one or more LED die or packed LEDs, which are collectively referred to herein as LEDs 102. A packaged LED is defined herein as an assembly of one or more LED die that contains electrical connections, such as wire bond connections or stud bumps, and possibly includes an optical element and thermal, mechanical, and electrical interfaces. The flange 110 may be used as a mechanical reference, as well as an additional surface for heat exchange. Additionally, the flange 110 may be configured so that conventional tools may be used to mount the LED module 100.

The LED module 100 is configured to be easily attached to a heat sink, fixture, or mounting frame by the threads 132 on the bottom section 130. With the use of fine threads 132, a large contact area is achieved, which helps to improve the thermal conduction between the LED module 100 to the part to which the LED module 100 is mounted. To improve thermal contact, a grease or tape with high thermal conductivity can be used on thread 132 while mounting the LED module 100. In addition to the bottom threads 132, the flange 110 itself may be used to provide additional contact area to the heat sink or frame, as well as simplify the mounting of the LED module 100.

The top section 120 may also include threads 124 that at least partially cover the external surface of the top section 120. Any size of screw thread can be used, but in one embodiment, the diameter of the top section 120 is smaller than the diameter of the bottom section 130 and the pitch of the top threads 124 will be less than the pitch of the bottom threads 132. The threads 124 on the top section 120 may be used to attach the module to a mounting plate, fixture or heat sink, or alternatively it can be used to attach additional optical components, e.g., a reflector, diffuser bulbs, dichroic filters, phosphor plates, or any combination of these parts.

In one embodiment, the thermal resistance from the LED board 104 to a heat sink, through the flange 110 and either the top threads 124 or bottom threads 132 is less than 10 degree Celsius per electrical watt (10 C/W) input power into the LED board 104. In other words, the temperature difference between the LED board 104 and one or more attached heat sink may be lower than 10 C/W.

The input power for the LED module 100 may be, e.g., in the range from 5 to 20 W and may be provided, e.g., by wires 134. In an alternative embodiment, more wires may be used, e.g., for a ground connection or for connecting the LEDs internal to the LED module 100 in groups. Additionally, sensors 101 can be integrated into the LED module 100, for example, a Thermistor, to measure the temperature in the module or one or more light diodes to measure the light within the internal cavity 121. Wires 134 can be used instead of a traditional lamp foot/socket combination, as the LED module has a long lifetime relative to conventional light sources, such as incandescent bulbs.

Figure 2:
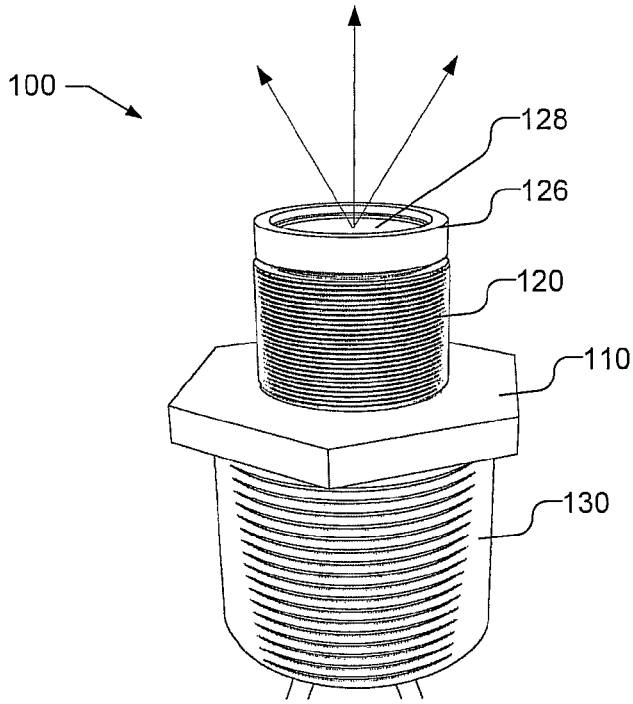
FIG. 2 is another perspective view of the LED module with an optical component mounted to the output port using a mounting ring.

FIG. 2 is another perspective view of LED module 100. As illustrated in FIG. 2, a mounting ring 126 may be used to couple an optical component 128, such as a reflector, lens, or an optically transparent or translucent plate, to the output port 122. The mounting ring 126 may be formed from metal or plastic and may be screwed, clamped, or glued to the top section 120 of the LED module 100. As illustrated in FIG. 2, the LED module 100 with mounting ring 126 is configured as a top emitter, e.g., with light being emitted in a direction that is generally parallel with normal to the output port 122 of the LED module 100, as illustrated by the arrows.

Figure 3:
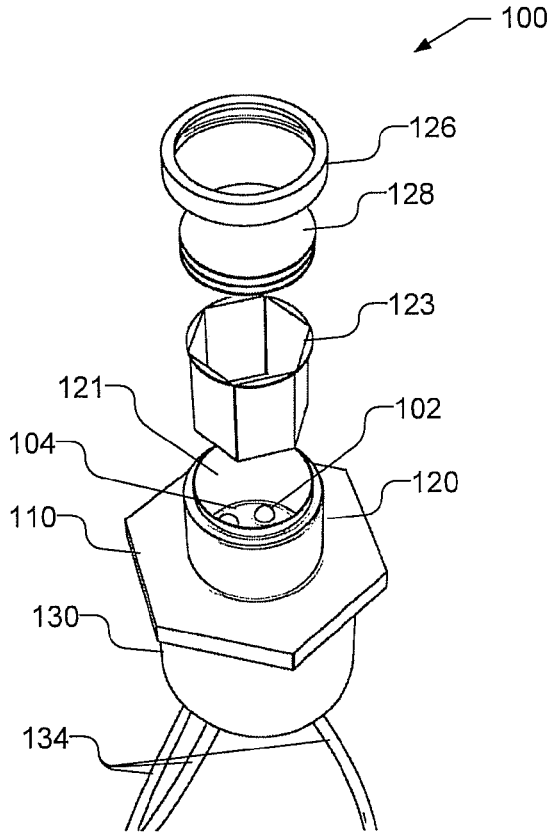
FIG. 3 is a perspective exploded view of an embodiment of the LED module of FIG. 2.

FIG. 3 is a perspective exploded view of an embodiment of the LED module 100. FIG. 3 illustrates the use of three wires 134 with the LED board 104. As illustrated in FIG. 3, the mounting ring 126 is used to couple one or more optical components 128, illustrated as a stack of components, to the top section 120 of the LED module 100. By way of example, the optical components 128 may include one or more of the following: dichroic filter(s); plates with dispersed wavelength converting particles, such as phosphor; transparent or translucent plates, which may include a layer or dots of wavelength converting material, such as phosphor, and plates with optical microstructures on one or both sides of the plate. As illustrated in FIG. 3, more than one optical component may be used so that the functions of the different components may be combined, for example, a wavelength converting layer may be applied to the surface of a dichroic mirror plate.

Additionally, FIG. 3 illustrates a cavity insert 123, which may be inserted into the cavity 121 of the top section 120. The cavity insert 123 may be made from a highly reflective material, and inserted into the top section 120 of the LED module 100 in order to enhance the efficiency of the LED module 100 and to improve the uniformity of the light distribution over the output port 122.

Figure 4:
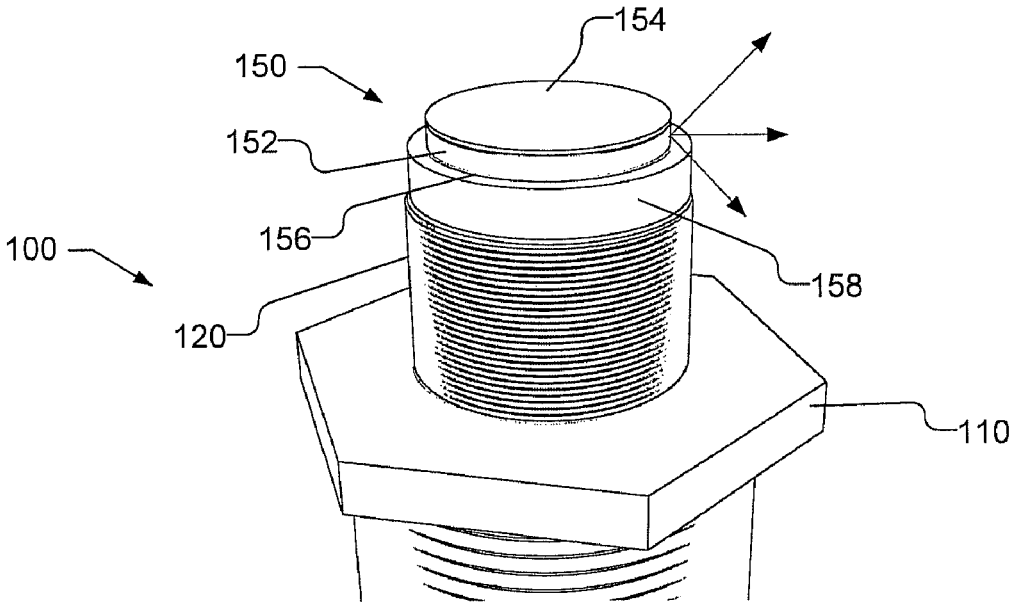
FIG. 4 illustrates a perspective view of the LED module with a side emitting optical component mounted to the output port using a mounting ring.
Figure 5:
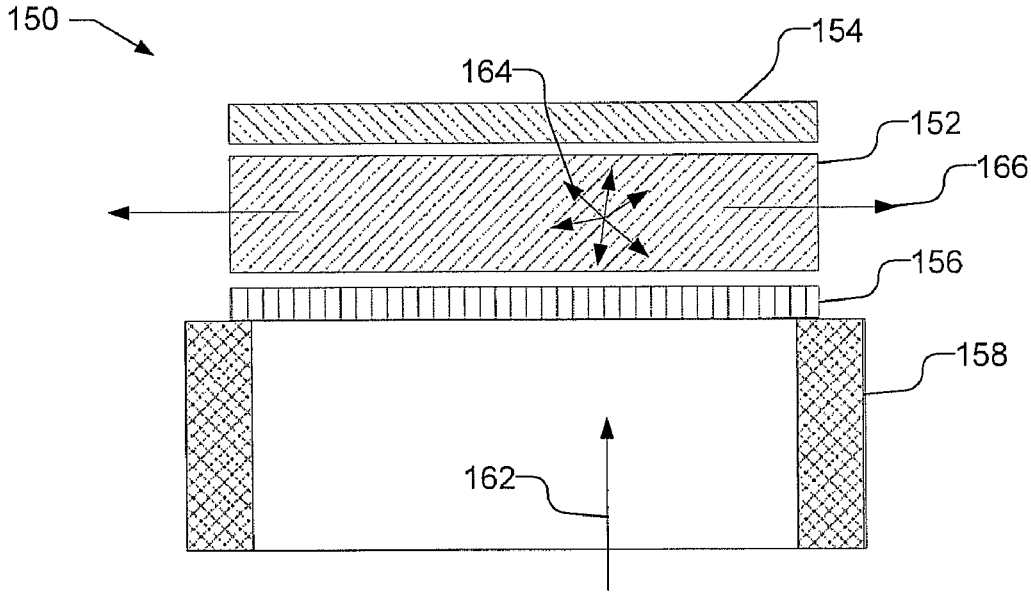
FIG. 5 is a cross-sectional view of the side emitting optical component structure from FIG. 4.

FIG. 4 illustrates a perspective view of the LED module 100, where the LED module 100 is configured with a side emission structure 150 to be a side emitter, e.g., with light being emitted in a direction that is generally perpendicular with normal to the output port 122 of the LED module 100, as illustrated by the arrows. FIG. 5 is a cross-sectional view of the side emission structure 150. The side emission structure 150 includes a side emission plate 152, which may be manufactured from one or more optically transparent or optically translucent material such as PMMA, glass, sapphire, quartz, or silicone. The plate 152 may be coated with wavelength converting material, e.g., phosphor, on one or both sides, e.g., by screen printing, or alternatively a solid layer. If desired, other types of plate 152 may be used that include particles from so called YAG silicate and/or nitride phosphors which are disbursed throughout the material or are attached to the top or bottom of the plate 152. On top of the plate 152 is a mirror 154 made from, e.g., a metal such as enhanced aluminum, manufactured by Alanod of Germany, or a highly reflective white diffuse material such as MC-PET, manufactured by Furukawa. Alternatively, the mirror 154 may be a substrate with a stack of dielectric layers. Additionally, a dichroic mirror 156 is mounted below the side emission plate 152, e.g., between the cavity 121 and the plate 152. The dichroic mirror 156 may transmit, e.g., blue or UV light, but reflect the light emitted by the wavelength converting materials in the side emission plate 152 located above the dichroic mirror 156. A support structure 158 is used to mount the plate 152, and mirrors 154, 156 to the top section 120 of the LED module 100. The support structure 158 may be, e.g., a mounting ring.

The plate 152 and mirrors 154, 156 may be held to the support section 158, e.g., by gluing or clamping, and the support section 158 is mounted to the top section 120 by glue, clamps or by threads.

Although FIG. 5 illustrates the plate 152 and mirrors 154 and 156 having gaps between them, the structures may be glued together with optically transparent bonds. Moreover, although three elements are shown (side emission plate 152 and mirrors 154 and 156), the functionality of each element may be combined into a fewer elements, e.g., one phosphor plate that is coated with a dielectric mirror on the bottom and a mirror on the top. The use of fewer elements may be used to reduce the cost of materials, but at the expense of optical efficiency.

As illustrated in FIG. 5, blue or UV light 162 from the cavity 121 of the LED module 100 is at least partially converted into light 164 with low energy (green, yellow, amber, red) and emitted in all directions, but is mostly transported to the edge of side emission plate 152 and emitted as light 166 due to total internal reflection on the surface of the plate 152 and by reflection at the top and bottom mirrors 154 and 156.

In one embodiment, the height of the emission area, i.e., the height of the edge of side emission plate 152, may be approximately 1 mm to 5 mm. A side emitting configuration of the LED module 100 may be useful to inject light into a light guide plate or when used in combination with a reflector, when a narrow beam is desired.

Figure 6:
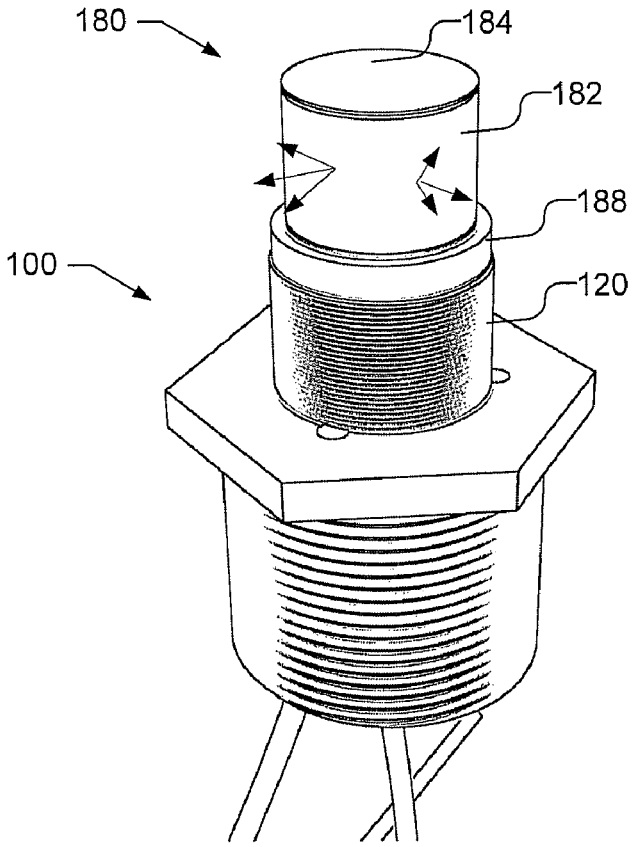
FIG. 6 illustrates a perspective view of the LED module with a cylindrical side emitting optical component mounted to the output port using a mounting ring.
Figure 7:
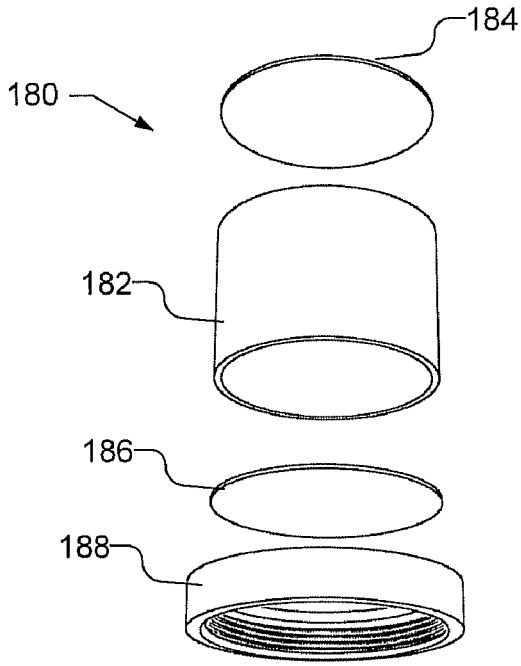
FIG. 7 is perspective exploded view of the cylindrical side emitting optical component from FIG. 6.

FIG. 6 illustrates a perspective view of the LED module 100, where the LED module 100 is configured with another side emission structure 180 to be a side emitter, e.g., with light being emitted in a direction that is generally perpendicular with normal to the output port 122 of the LED module 100, as illustrated by the arrows. FIG. 7 is perspective exploded view of the side emission structure 180. The side emission structure 180 includes a translucent or transparent cylindrical side walls 182 through which is emitted. The cylindrical side walls 182 may be, e.g., plastic, such as PMMA, or glass, and may be manufactured by an extrusion process. In one embodiment, the thickness of the walls of the cylindrical side walls 182 maybe between 100 μm and 1 mm. If desired, the cylindrical side walls 182 may have a cross-section other than circular, e.g., polygonal. Moreover, the side walls 182 may contain wavelength converting materials, e.g., phosphors, either embedded in the side walls 182 or applied to either the inside or the outside of the side walls 182. The wavelength converting material may be uniformly distributed over the side walls 182 or distributed in a non-uniform fashion that is optimized for the desired application.

A top plate 184 is mounted on the top of the cylindrical side walls 182. The top plate 184 may be a reflector manufactured from material having high optical reflectivity, such as Miro material manufactured by Alanod, or it can be a translucent or transparent material, such as MC-PET manufactured by Fukurawa. In one embodiment, the top plate 184 has similar optical properties as the cylindrical side walls 182 and, thus, in this embodiment, light is also emitted through the top plate 184. Top plate 184 may be flat, but may have other configurations, including cone shaped. If desired, the top plate 184 may include multiple layers to enhance the reflective properties. Moreover, the top plate 184 may include wavelength converting material, e.g., in one or more layers. The wavelength converting material may be screen printed as a pattern of dots and can vary in composition, position, thickness, and size.

Additionally, if desired, a dichroic mirror 186 (shown in FIG. 7) may be included in the side emission structure 180. The optional dichroic mirror 186 may be configured to be mainly transmissive for blue and UV light, and to reflect light with a longer wavelength, which may be produced by wavelength converting materials in or on the cylindrical side walls 182 and/or top plate 184.

A mounting ring 188 attaches the side emission structure 180 to the top section 120 of the module. The cylindrical side walls 182 may be attached to the mounting ring 188 by glue or clamps, and the mounting ring 188 maybe mounted to the top section 120 by glue, clamps or by threads. The side emission structure 180 may be treated as a separate subassembly in order for optical properties to be independently tested.

Figure 8:
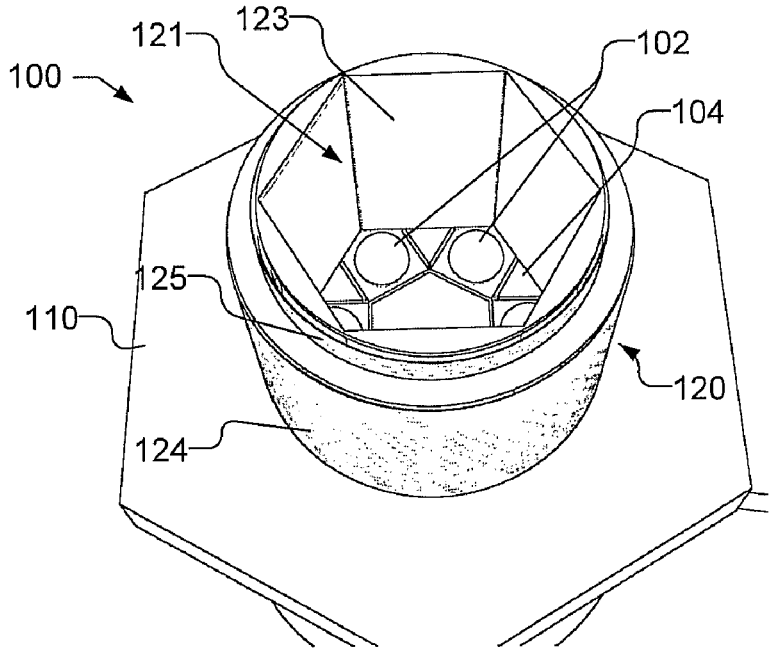
FIG. 8 is a top perspective view of one embodiment of the internal cavity of the upper housing of the LED module.

FIG. 8 is a top perspective view of one embodiment of the cavity 121 of the LED module 100, which a portion of the LED board 104 and the LEDs 102 exposed. In the configuration illustrated in FIG. 8, the LEDs 102 are configured rotationally symmetric, but any other configuration could be used as well. The reflective cavity insert 123 is illustrated as having a hexagonal configuration, but other geometric configurations may be used if desired.

Additionally, as illustrated in FIG. 8, the top section 120 may include two separate sets of threads, e.g., threads 124, which may be used to attach the LED module 100 to a mounting plate, fixture or heat sink, and a second set of threads 125, which may be used to attach the mounting rings 126, 188 illustrated in FIGS. 2 and 6, or the support structure 158 illustrated in FIG. 4.

Figure 9:
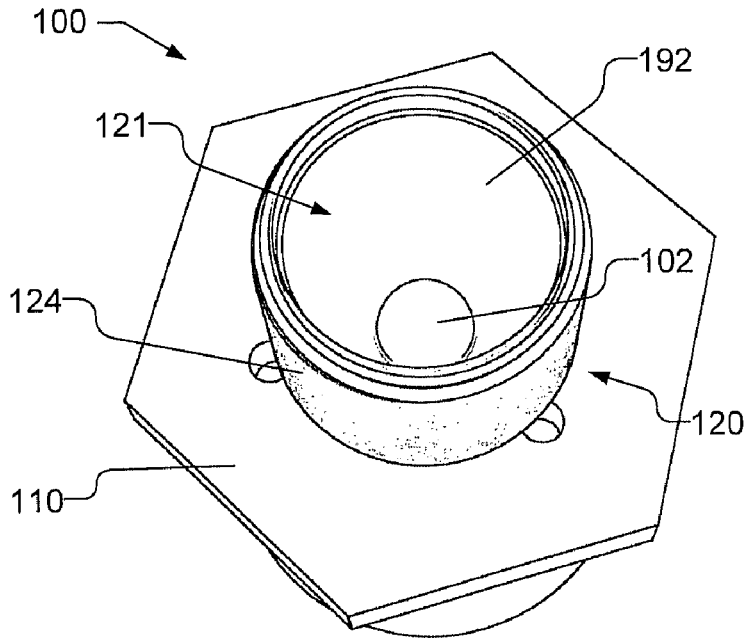
FIG. 9 is a top perspective view of another embodiment of the internal cavity of the upper housing of the LED module.

FIG. 9 is another top perspective view of an embodiment of the cavity 121 of the LED module 100. As illustrated in FIG. 9, however, a single central LED 102 is used with a curved reflective insert 192. The single LED 102 may be, e.g., a high power packaged LED, such as a Luxeon® III produced by Philips Lumileds Lighting Company, or an OSTAR® produced by OSRAM. The LED 102 may include one or more LED chips, and as illustrated in FIG. 9 may include a lens. The reflective insert 192 may be a collimating reflector used to collimate the light from the LED 102, such as a compound parabolic concentrator (CPC) or an elliptical shaped reflector. Alternatively, a total internal reflection (TIR) collimator may be used. In another embodiment, the collimating reflector may be formed from the sidewalls of the cavity 121, as opposed to using a separate insert component.

Figure 10:
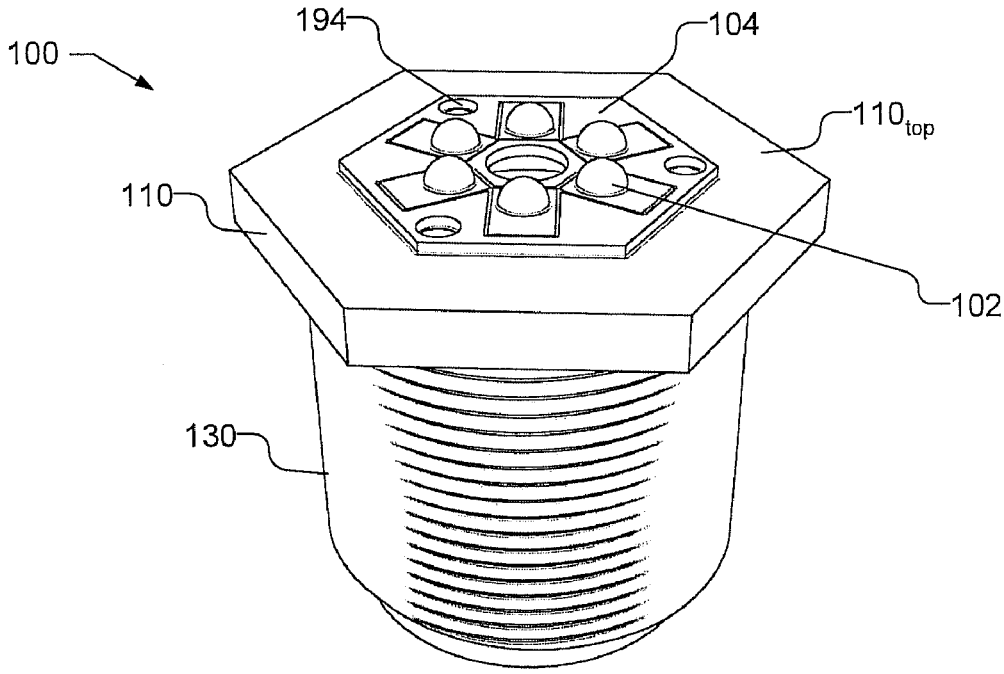
FIG. 10 illustrates a perspective view of one embodiment of the LED module with the LED board and LEDs mounted on the top surface of the flange.

FIG. 10 illustrates a perspective view of one embodiment of the LED module 100 with the top section 120 removed so that the LED board 104 and LEDs 102 can be clearly seen. As can be seen in FIG. 10, the LEDs 102 may be packaged LEDs, e.g., including its own optical element and board with electrical interfaces. In some embodiments, however, the LED 102 may be an LED die that is mounted to the board 104 instead of a packaged LED. The LED board 104 is mounted on the top surface $\mathbf{110}_{top}$ of the flange 110. Mounting holes 194 may be used to attach the LED board 104 to the flange 110, e.g., using screws or bolts. The LED board 104 may include a highly reflective top surface. The LED board 104 may include thermal and electrical vias that provide thermal and electrical contact with the underside of the LED board 104. No electrical wires are shown at the bottom section 130 of the LED module 100 as in this embodiment, electrical pads are used instead of wires, as will be described in more detail in FIGS. 15A and 15B. The top section 120 may be attached to the flange 110 (if used) or the bottom section 130, e.g., by gluing, screwing, welding, soldering, clamping or through other appropriate attaching means.

Figure 11:
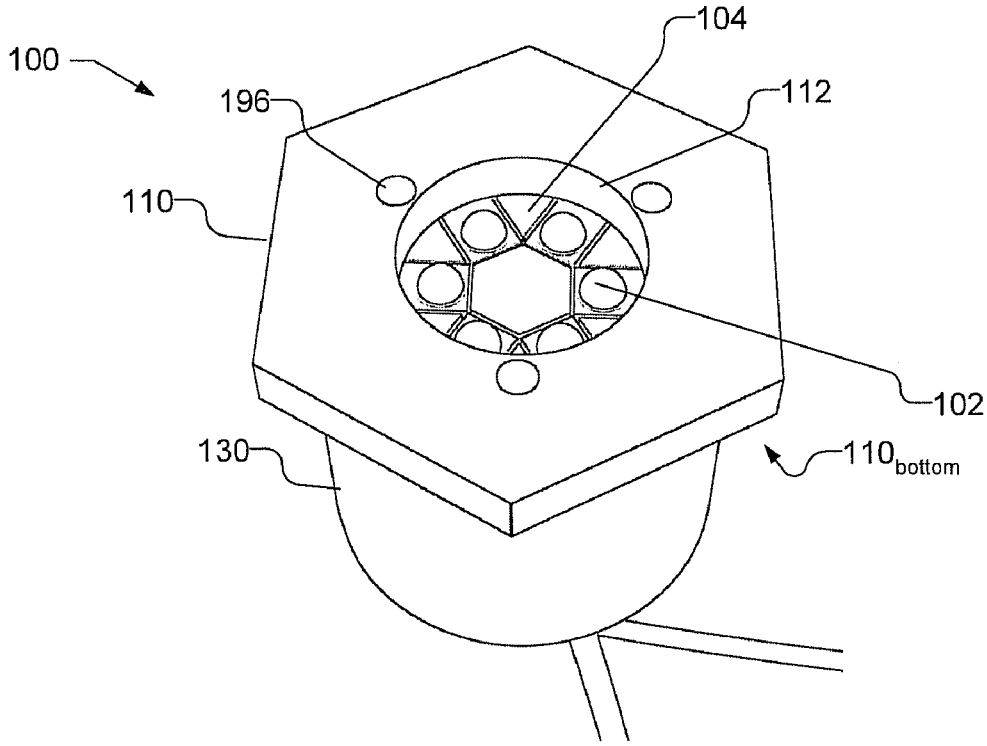
FIG. 11 illustrates a perspective view of one embodiment of the LED module with the LED board and LEDs mounted on the bottom surface of the flange.

FIG. 11 illustrates another perspective view of an embodiment of the LED module 100 with the top section 120 removed so that the LED board 104 and LEDs 102 can be clearly seen through an aperture 112 in the flange 110. The LED board is mounted inside the bottom section 130 of the LED module 100, for example, using a separate mechanical support section. In one embodiment, the LED board 104 may be mounted to the bottom surface $\mathbf{110}_{bottom}$ of the flange 110, e.g., using mounting holes 196 in the flange 110. If desired, a reflector insert may be placed inside the aperture 112 to and around the LEDs 102 to reflect light towards the output port in the top section 122. As an alternative, the inside surface of the aperture 112 in the flange 110 may be constructed of, or coated with, a highly reflective material, such as enhanced aluminum, manufactured by Alanod of Germany, or a highly reflective white diffuse material such as MC-PET, manufactured by Furukawa.

Figure 12:
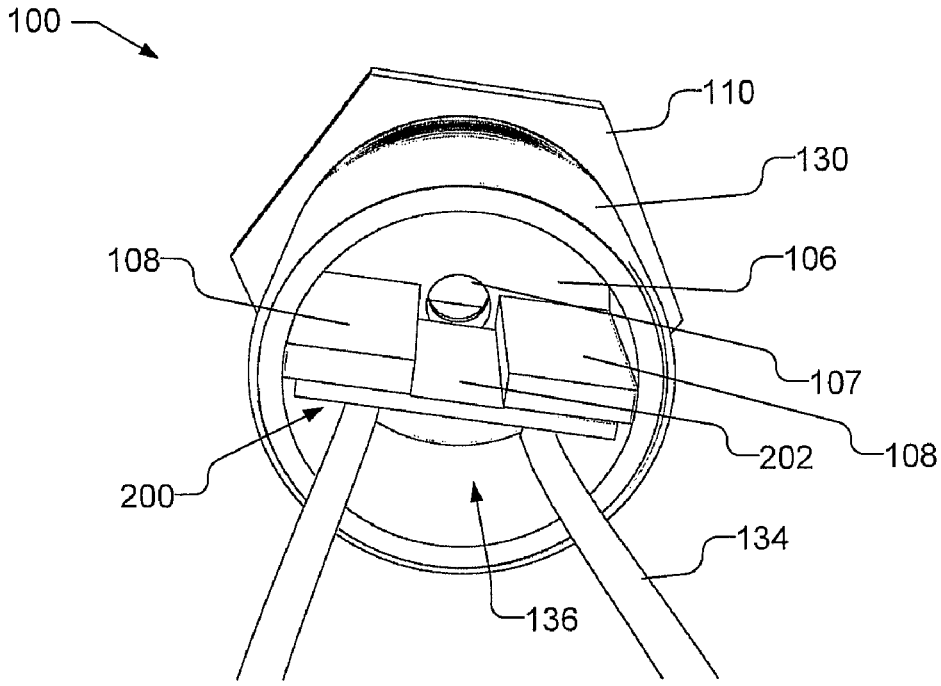
FIG. 12 is a bottom perspective view of the LED module illustrating an internal cavity of the lower housing.

FIG. 12 is a bottom perspective view of the LED module 100 illustrating a cavity 136 in the bottom section 130. A heat spreader 106 on the bottom of the LED board 104 is shown with two ribs 108 protruding downward. The ribs 108 serve as additional heat spreaders and as support for an optional LED driver circuit board 202, to which is attached the wires 134. An aperture 107 through the heat spreader 106 is aligned with an aperture in the LED board 104 and the aperture 112 through the flange 110 (shown in FIG. 11) and may be used to bring additional parts into the cavity 121 of the top section 120 of the LED module 100, for example, to adjust the optical properties of the cavity 121 to change the color point or angular profile of the light source emission. In one embodiment, a cap maybe placed over the cavity 136 of the bottom section 130.

Figure 13:
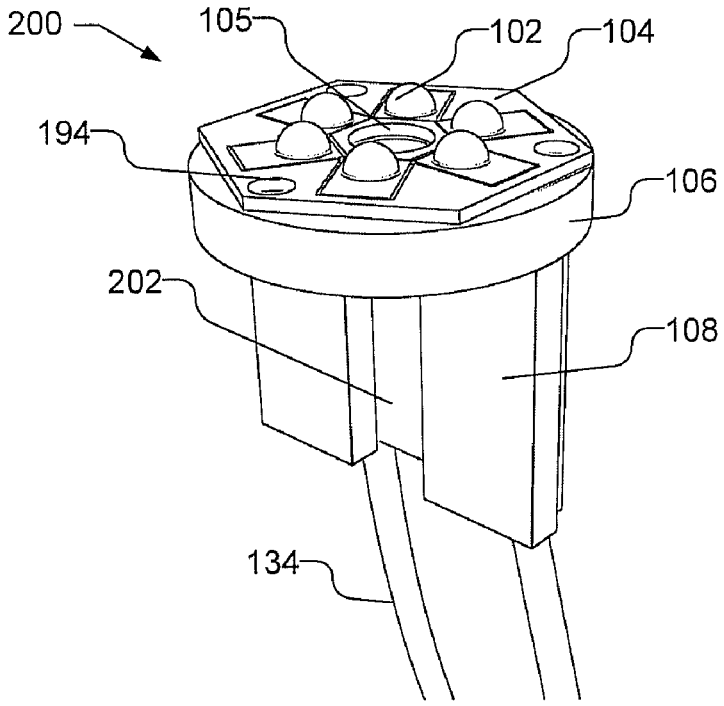
FIG. 13 illustrates a perspective view of a sub-assembly that includes the LEDs, the LED board, heat spreader, ribs, and an LED driver circuit board.

The LED board 104 with the heat spreader 106, ribs 108 and LED driver circuit board 202 may be a separate sub-assembly 200, which can be tested before mounting to the LED module 110. FIG. 13 illustrates a perspective view of the sub-assembly 200 including the LEDs 102, the LED board 104, heat spreader 106, ribs 108, and LED driver circuit board 202. While only one LED driver circuit board 202 is illustrated in FIGS. 12 and 13, an additional driver circuit board may be used and positioned on the opposite side of the ribs 108. The central aperture 105 in the LED board 104 may be aligned with the aperture 107 in the heat spreader 106 (shown in FIG. 12) and the aperture 112 in the flange 110 (shown in FIG. 11) to permit access into the cavity 121 in the top section 120, e.g., for optional color adjustment members. The sub-assembly 200 can be mounted to the LED module 100 by, e.g., screw threads on the side of the heat spreader 106 that can be used to screw the sub-assembly 200 inside the bottom section 130. Alternatively, the mounting holes 194 may be used to mount the sub-assembly 200 to the flange 110 with screws or bolts. The sub-assembly 200 may be placed in good thermal contact with the LED module 100 using, e.g., thermal paste.

Figure 14:
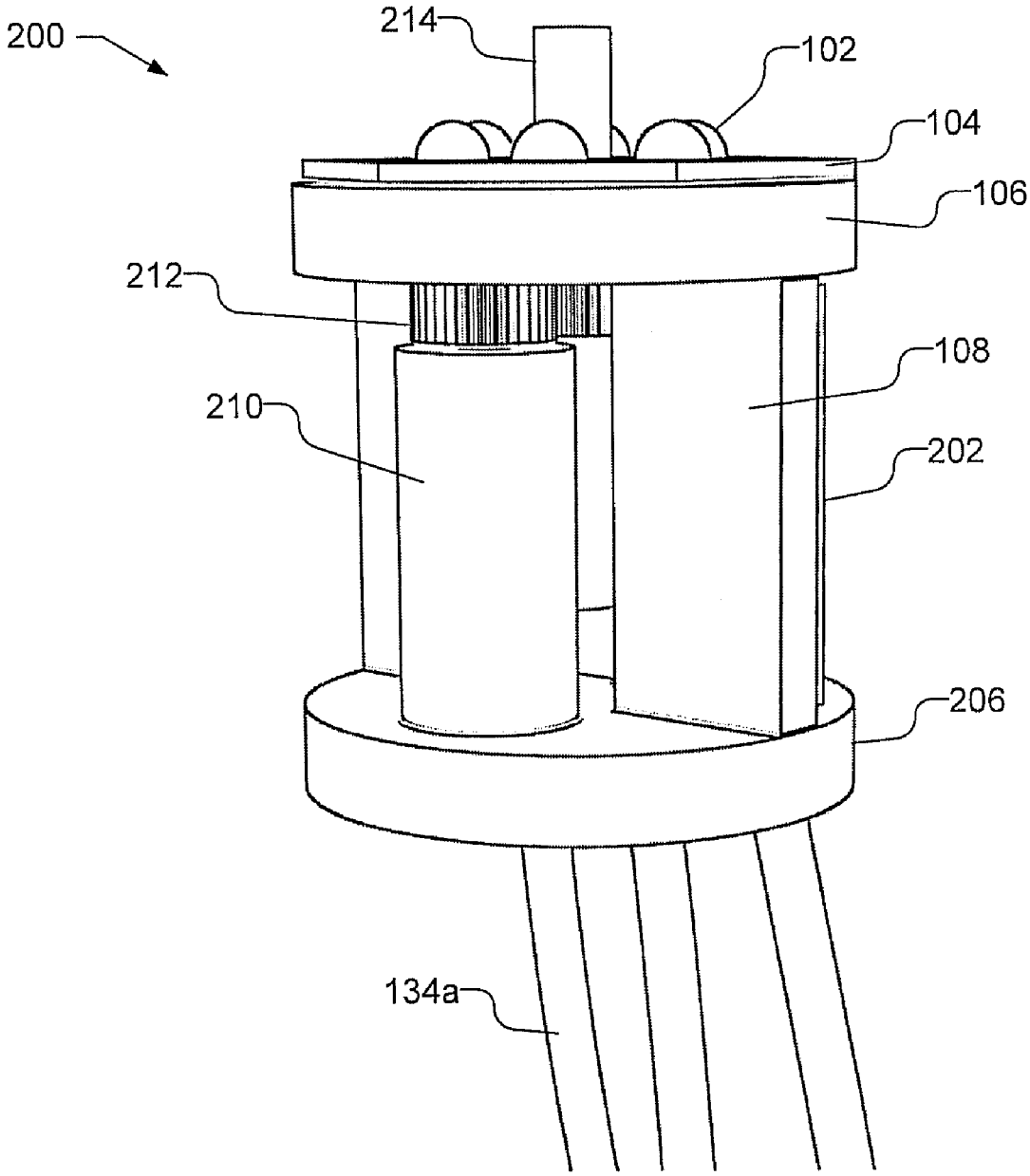
FIG. 14 illustrates another embodiment of a sub-assembly that includes the LEDs, the LED board, heat spreader, ribs, an LED driver circuit board and an actuator and movable adjustment member.

FIG. 14 illustrates another embodiment of a sub-assembly 200 with LEDs 102, the LED board 104, heat spreader 106, ribs 108, LED driver circuit board 202, and an actuator 210. A cap 206 that supports the actuator 210 and also covers the cavity 136 of the bottom section 130 is also shown. The actuator 210 may be a motor such as those produced by Micromo Electronics. The actuator 210 includes gears 212 that are used to move an adjustment member 214 up and down into the cavity 121 of the top section 120 (shown in, e.g., FIGS. 8 and 9) to change the radiation pattern, and/or to change either the color or color temperature of the light output. The actuator member 214 may include a screw thread, which raises the actuator member 214 up and down as the gears 212 rotate. A third wire 134*a* is used to control the actuator 210.

Figure 15A:
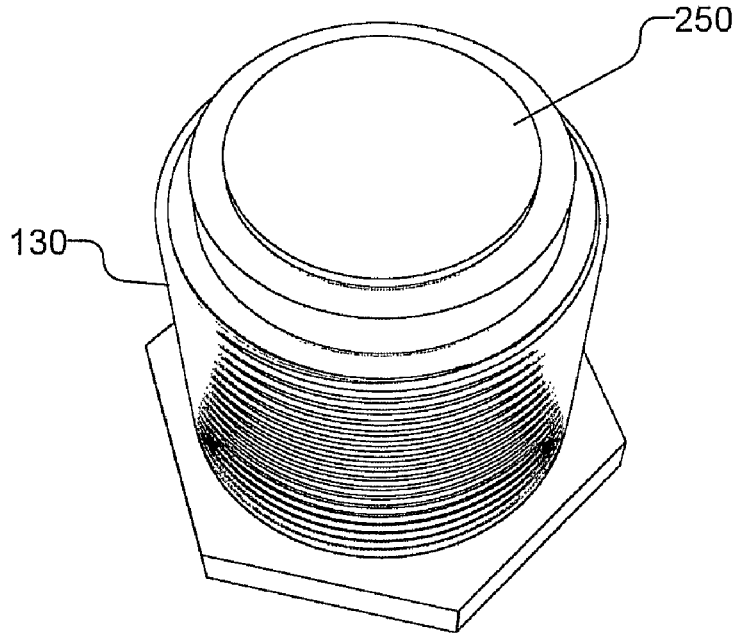
FIGS. 15A and 15B illustrate perspective views of one embodiment of the lower housing where no wires are used for the electrical connections.
Figure 15B:
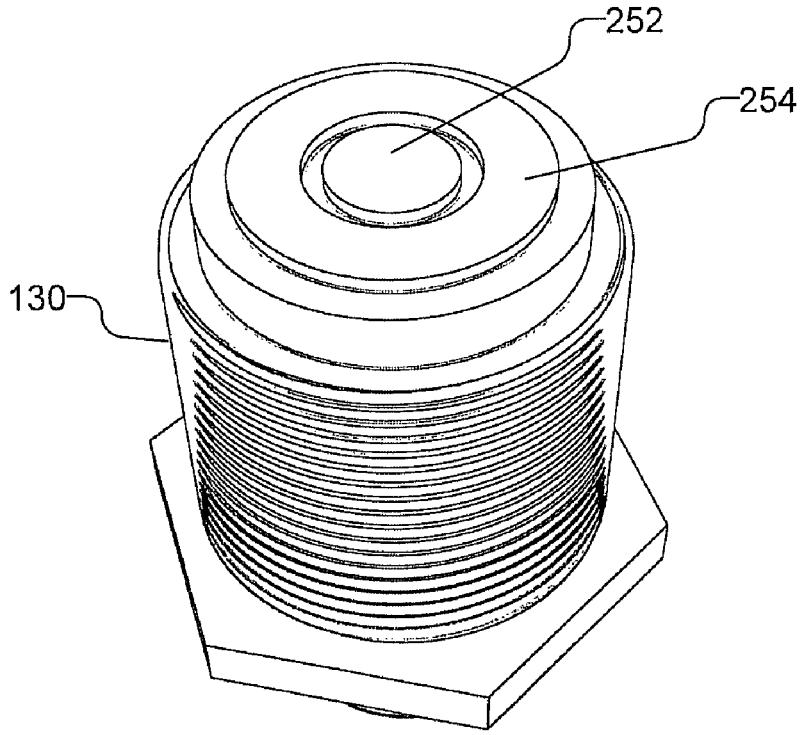

FIGS. 15A and 15B illustrate perspective views of one embodiment of the bottom section 130 where no wires are used for the electrical connections. Instead of wires, contact pads are used. For example, in FIG. 15A, a single contact pad 250 on the bottom surface of the bottom section 130 is used, and sides of the bottom section 130 serves as the second electrical contact. FIG. 15B illustrates the use of two concentric contact pads 252 and 254 on the bottom surface of the bottom section 130, e.g., a central pad 252 surrounded by a ring shaped pad 254. If desired, the sides of the bottom section 130 in FIG. 15B may serve as a third contact, e.g., for ground. The number of contact pads can be increased, for example, for read out of a temperature sensor in the module. Additionally, the contact pads can be used with multiple functions, for example, by encoding the sensor data as a differential signal.

Figure 16:
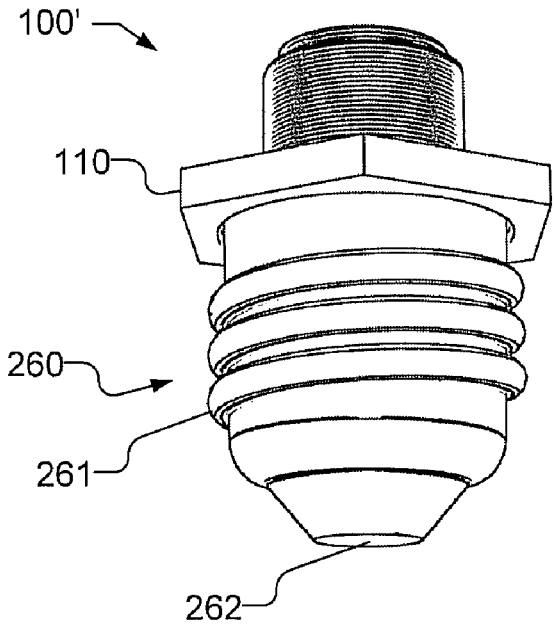
FIG. 16 illustrates a perspective view of another embodiment of a lower housing in which no wires are used for electrical connections.

FIG. 16 illustrates a perspective view of another embodiment of a bottom section 260 in which no wires are used for electrical connections. The bottom section 260 shown in FIG. 16, is similar to the bottom section shown in FIG. 15A, except that bottom section 260 is configured as a conventional lamp base, such as an E26 or E37, which is used for conventional incandescent lamps. The bottom section 260 has two electrical connections, contact pad 262 at the base of the bottom section 260 and the sides of the bottom section 260, including threads 261, serves as the other electrical contact. The flange 110 can be used to screw the LED module 100' into a lamp base. The flange 110 may be made of a thermally conductive material, but is electrically isolated. Furthermore, the flange 110 is large enough that the contacts in the socket are not touched by hand.

Figure 17:
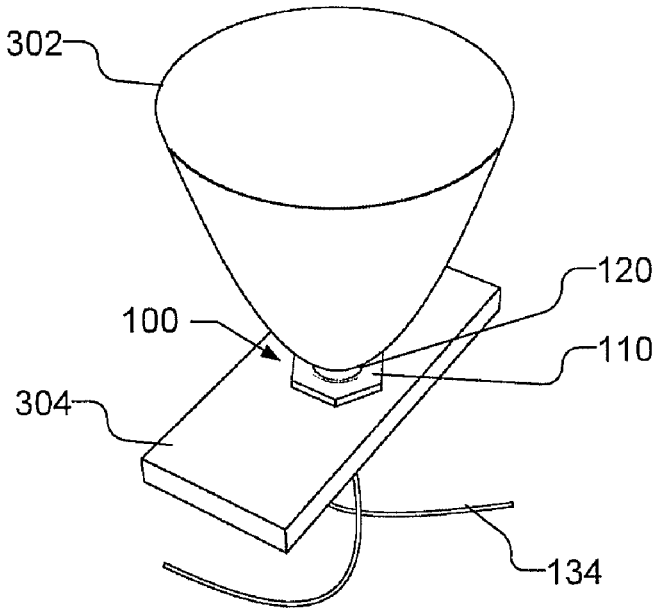
FIG. 17 shows an example of the LED module mounted to a reflector and a metal bracket or heat sink.

FIG. 17 shows an example of the LED module 100 mounted to a reflector 302 and a metal bracket 304 or heat sink, where only the flange 110 and wires 134 of the LED module 100 can be seen. The metal bracket 304 can either be part of the fixture with which the LED module 100 is used or the metal bracket 304 can be part of, e.g., a ceiling, wall, floor or connection box. The bottom section 130 of the LED module 100 can be screwed into the metal bracket 304. The reflector 302 may be made out of a material with high thermal conductivity, e.g., a metal such as aluminum and may have a highly reflective coating on the inside. The reflector 302 may have a conical shape, such as a parabola or compound parabolic shape. The reflector 302 may be screwed onto the top section 120 of the LED module 100 to achieve a good thermal contact. A thermal paste can be used to enhance the thermal contact between the threads of the top section 120 of the LED module 100 and the reflector 302.

Figure 18:
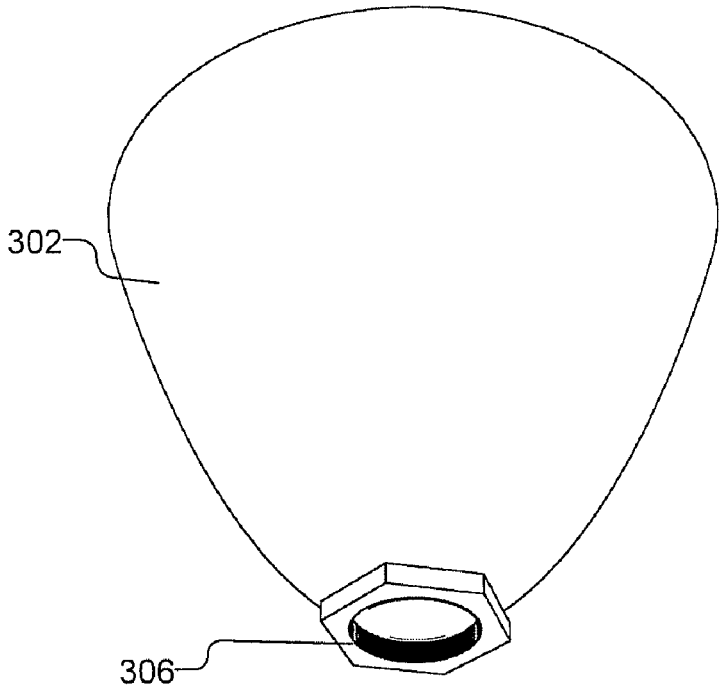
FIG. 18 is a bottom view of a reflector that may be used with the LED module.

FIG. 18 is a bottom view of the reflector 302. As can be seen, the reflector 302 may include a threaded nut 306, which is screwed onto the threads 124 (FIG. 1) of the top section 120 of the LED module 100. The reflector 302 can be produced, e.g., by electro-forming or stamping. The threads on the reflector 302 can be integrally formed in a stamped reflector or it can be a separate component, which is bonded by welding, gluing or clamping.

Figure 19:
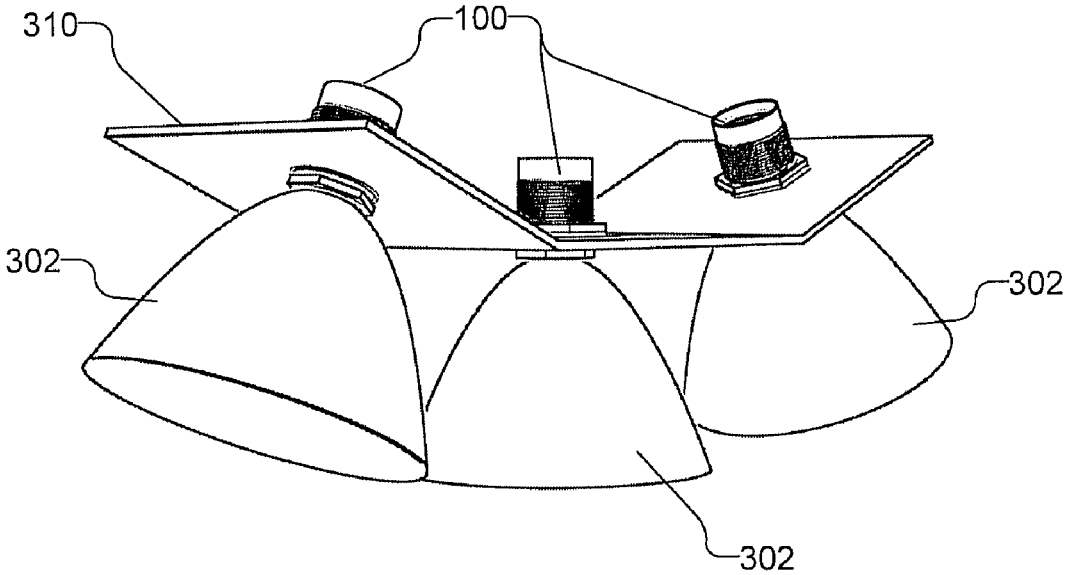
FIG. 19 illustrates a plurality of LED modules with reflectors attached to a bended frame.

FIG. 19 illustrates a plurality of LED modules 100 with reflectors 302 attached to a bended frame 310, which may be part of a fixture or heat sink. The use of multiple LED modules 100 increases light output. Moreover, by orienting the LED modules 100 in different directions, the intensity distribution can be optimized for desired applications. Of course, if desired, larger arrays can be utilized, for example, for outdoor or stadium lighting.

Figure 20:
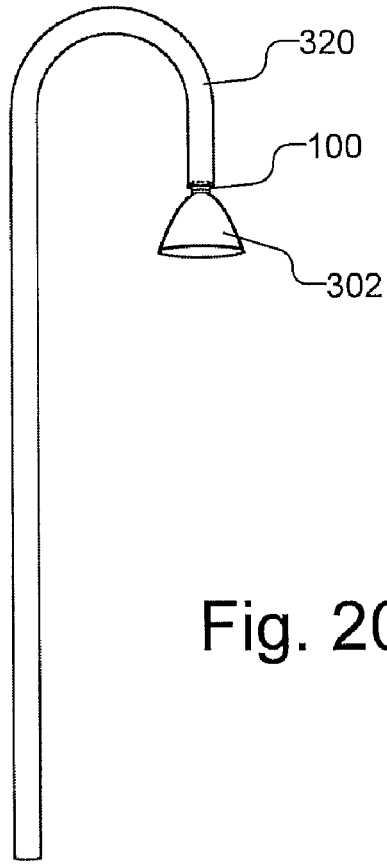
FIG. 20 illustrates an LED module with a reflector configured in a street light application.

FIG. 20 illustrates an LED module 100 with a reflector 302 configured in a street light application by attaching the LED module 100 to a pole 320. By manufacturing the pole 320 of thermally conductive material, no additional heat sinks or heat spreaders are required, as the pole 320 acts as a heat exchanger.

Figure 21:
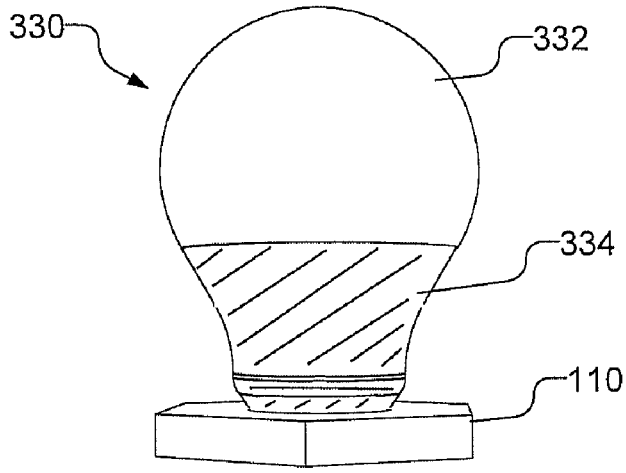
FIG. 21 shows another example of a bulb shaped optical element that may be attached to the upper housing of the LED module.

FIG. 21 shows another example of an optical element 330 that may be attached to the top section 120 of the LED module 100, where only the flange 110 of LED module 110 is shown. The optical element 330 has the shape of a regular incandescent bulb (sometimes referred to as bulb element 330) that is screwed onto the top section 120 of the LED module 100. If desired, however, the optical element 330 may be attached directly to the flange 110. The bulb element 330 may include an optical translucent top section 332 and a reflective bottom section 334. The bottom section 334 is preferably made of a material with high thermal conductivity as well as having high reflectivity, such as Miro material manufactured by Alanod, however, other materials can be used as well. In one embodiment, the reflective bottom section 334 may include multiple shells of thermally conductive material, e.g., the outer shell having a high thermal conductivity and the inner shell having a high optical reflectivity. Alternatively, the bottom section 334 may be formed from a material with high thermal conductivity that is coated with a coated with a highly reflective coating, which can be a diffusive coating, such as white paint, or a metal coating made of, e.g., aluminum or silver with a protective layer.

Although the present invention is illustrated in connection with specific embodiments for instructional purposes, the present invention is not limited thereto. Various adaptations and modifications may be made without departing from the scope of the invention. Therefore, the spirit and scope of the appended claims should not be limited to the foregoing description.

What is claimed is:

1. An apparatus comprising:

at least one light emitting diode mounted to a mounting board;

an upper housing having an internal cavity with a reflective insert coupled therein, a light output port, and a cylindrically shaped externally threaded surface, the at least one light emitting diode emits light into the internal cavity; and a lower housing having a cylindrically shaped, externally threaded surface, wherein electrical contact to the at least one light emitting diode is provided through the lower housing; and a flange separating the upper housing and the lower housing, wherein the mounting board is coupled to a surface of the flange.

2. The apparatus of claim 1, wherein the at least one light emitting diode is at least one packaged light emitting diode.

3. The apparatus of claim 1, wherein the cylindrically shaped, externally threaded surface of the lower housing is configured as part of a fastener.

4. The apparatus of claim 3, further comprising one of a heat sink, bracket or frame having a part of a fastener that mates with the part of the fastener of the cylindrically shaped, externally threaded surface, wherein the cylindrically shaped, externally threaded surface of the lower housing is mounted to the heat sink, bracket or frame.

5. The apparatus of claim 3, wherein the part of the fastener of the cylindrically shaped, externally threaded surface of the lower housing comprises screw threads.

6. The apparatus of claim 1, wherein the lower housing comprises an internal cavity, the LED module further comprising a driver board for the at least one light emitting diode in the internal cavity of the lower housing.

7. The apparatus of claim 1, at least one electrical wire provides the electrical contact through the lower housing to the at least one light emitting diode.

8. The apparatus of claim 1, further comprising a Thermistor thermally coupled to the internal cavity of the upper housing.

9. The apparatus of claim 1, further comprising a light diode optically coupled to the internal cavity of the upper housing to measure the light within the internal cavity.

10. The apparatus of claim 1, wherein the mounting board is coupled to a top surface of the flange between the flange and the upper housing, and wherein a plurality of wires are coupled to the mounting board and extend through an aperture of the flange.

11. The apparatus of claim 1, wherein the mounting board is coupled to the bottom surface of the flange between the flange and the lower housing light emitted from the at least one light emitting diode is emitted through an aperture of the flange.

12. The apparatus of claim 1, wherein the cylindrically shaped, externally threaded surface of the upper housing is configured as part of a fastener.

13. The apparatus of claim 12, further comprising a reflector having a part of a fastener that mates with the part of the fastener of the cylindrically shaped, externally threaded surface of the upper housing.

14. The apparatus of claim 1, further comprising an adjustment member and an actuator to raise or lower the adjustment member in the internal cavity of the upper housing.

15. The apparatus of claim 1, further comprising a heat spreader thermally coupled to the mounting board.

16. The apparatus of claim 1, wherein the reflective insert has a cross section that is circular, hexagonal, tapered or compound parabolic concentrator shaped.

17. The apparatus of claim 1, wherein the light output port has at least one of a transparent and translucent planar optical structure.

18. The apparatus of claim 17, wherein the optical structure comprises a phosphor.

19. The apparatus of claim 17, further comprising a dichroic minor between the at least one light emitting diode and the optical structure.

20. The apparatus of claim 17, wherein the light output port is located at a top surface of the upper housing opposite a position of the at least one light emitting diode.

21. The apparatus of claim 17, wherein the optical structure has one of a disk shape or a cylinder shape.

22. The apparatus of claim 21, wherein light is emitted through at least one of a top surface and an edge surface of the optical structure.

23. The apparatus of claim 17, wherein the optical structure is mounted to the upper housing with a mounting ring that is threadedly coupled to the upper housing.

24. The apparatus of claim 1, wherein light emitted from the at least one light emitting diode exits the apparatus through the light output port.

25. The apparatus of claim 1, wherein light emitted from the at least one light emitting diode exits the apparatus in a direction perpendicular to the light output port.

26. The apparatus of claim 1, wherein a diameter of the cylindrically shaped, externally threaded surface of the upper housing is less than a diameter of the cylindrically shaped, externally threaded surface of the lower housing.

27. The apparatus of claim 1, wherein the cylindrically shaped externally threaded surface is a first cylindrically shaped externally threaded surface, the upper housing having a second cylindrically shaped externally threaded surface that is different than the first cylindrically shaped externally threaded surface.

28. The apparatus of claim 27, wherein a mounting ring is attached to the second cylindrically shaped externally threaded surface.

29. An apparatus comprising:

at least one light emitting diode mounted to a mounting board;

an upper housing having an internal cavity with a reflective insert coupled therein and a light output port, the at least one light emitting diode emits light into the internal cavity that exits through the light output port, the upper housing having a cylindrical external surface with screw threads;

a flange coupled to the upper housing, wherein the mounting board is coupled to a surface of the flange;

a lower housing that is separate from the upper housing and is attached to the upper housing through the flange, the lower housing having a cylindrical external surface with screw threads, the at least one light emitting diode being thermally coupled to the lower housing through the flange and wherein electrical contact to the at least one light emitting diode is provided through the lower housing.

30. The apparatus of claim 29, wherein the at least one light emitting diode is at least one packaged light emitting diode.

31. The apparatus of claim 29, further comprising one of a heat sink, bracket or frame threadedly coupled to the screw threads on the cylindrical external surface of the lower housing.

32. The apparatus of claim 29, wherein the lower housing comprises an internal cavity, the apparatus further comprising a driver board for the at least one light emitting diode in the internal cavity of the lower housing.

33. The apparatus of claim 29, wherein at least one electrical wire provides the electrical contact through the lower housing to the at least one light emitting diode.

34. The apparatus of claim 29, wherein the lower housing comprises at least one electrical contact pad to provide electrical contact to the at least one light emitting diode.

35. The apparatus of claim 34, wherein the cylindrical external surface of the lower housing provides electrical contact to the at least one light emitting diode.

36. The apparatus of claim 29, wherein the mounting board is coupled to a top surface of the flange between the flange and the upper housing, and wherein a plurality of wires are coupled to the mounting board and extend through an aperture of the flange.

37. The apparatus of claim 29, wherein the mounting board is coupled to the bottom surface of the flange between the flange and the lower housing, and wherein light emitted from the at least one light emitting diode is emitted through an aperture of the flange.

38. The apparatus of claim 29, further comprising an adjustment member and an actuator to raise or lower the adjustment member in the internal cavity of the upper housing.

39. The apparatus of claim 29, further comprising a heat spreader thermally coupled to the mounting board, wherein the mounting board and heat spreader are mounted inside an internal cavity of the lower housing.

40. The apparatus of claim 29, wherein the reflective insert has a cross section that is circular, hexagonal, tapered or compound parabolic concentrator shaped.

41. The apparatus of claim 29, wherein the light output port has at least one of a transparent and translucent planar optical structure.

42. The apparatus of claim 41, wherein the optical structure comprises a phosphor.

43. The apparatus of claim 41, further comprising a dichroic minor between the at least one light emitting diode and the optical structure.

44. The apparatus of claim 41, wherein the light output port is located at a top surface of the upper housing opposite a position of the at least one light emitting diode.

45. The apparatus of claim 41, wherein the optical structure has one of a disk shape or a cylinder shape.

46. The apparatus of claim 45, wherein light is emitted through at least one of a top surface and an edge surface of the optical structure.

47. The apparatus of claim 41, wherein the optical structure is mounted to the upper housing with a mounting ring that is threadedly coupled to the upper housing.

48. An apparatus comprising:

a plurality of light emitting diodes mounted to a mounting board;

an upper housing having a cavity and a light output port, and a cylindrically shaped externally threaded surface;

a reflective insert that is inserted into the cavity of the upper housing and forms reflective sidewalls of the cavity of the upper housing, wherein the plurality of light emitting diodes emit light directly into the cavity that is reflected by the reflective sidewalls and exits through the light output port;

at least one of a transparent and translucent optical structure comprising phosphor mounted over the light output port;

a lower housing having a cylindrical external surface with screw threads adapted for a lamp base, the lower housing having an internal cavity, wherein electrical contact to the plurality of light emitting diodes is provided through the screw threads of the cylindrical external surface and the internal cavity of the lower housing; and a flange separating the upper housing and the lower housing, wherein the mounting board is coupled to a surface of the flange.

49. The apparatus of claim 48, wherein the flange is a heat sinking flange to which the plurality of light emitting diodes is thermally coupled.

50. The apparatus of claim 48, wherein the lamp base is an E26 base.

51. The apparatus of claim 48, wherein the phosphor is dispersed in the optical structure.

52. The apparatus of claim 48, wherein the optical structure comprises a combination of different phosphors.

53. The apparatus of claim 52, wherein the combination of different phosphors comprises a yellow phosphor and a red phosphor.

54. The apparatus of claim 48, wherein the plurality of light emitting diodes emit blue light.

55. The apparatus of claim 48, wherein the lower housing is separate from the upper housing and is attached to the upper housing through the flange.

* * * * *